United States Patent [19]

Schuster et al.

[11] Patent Number: 4,836,375

[45] Date of Patent: Jun. 6, 1989

[54] WRAP-AROUND CARRIER

[75] Inventor: Richard L. Schuster; Gordon C. Wilkinson, both of Monroe, La.

[73] Assignee: Manville Corporation, Denver, Colo.

[21] Appl. No.: 90,811

[22] Filed: Aug. 28, 1987

[51] Int. Cl.[4] ..... B65D 85/20; B65D 5/46

[52] U.S. Cl. ..... 206/427; 206/614; 229/40; 229/52 BC

[58] Field of Search ..... 229/40, 52 B, 52 BC; 206/427, 140, 145–161, 614, 612

[56] References Cited

U.S. PATENT DOCUMENTS

| | | | |
|---|---|---|---|
| 2,296,228 | 9/1942 | Powell | 229/52 BC |
| 2,368,203 | 1/1945 | Crave | 229/52 BC |
| 2,877,894 | 3/1959 | Forrer | 229/52 BC |
| 3,189,215 | 6/1965 | Currie, Jr. | 229/52 B |
| 3,373,867 | 3/1968 | Wood | 206/140 |
| 3,552,082 | 1/1971 | Howard | 206/614 |
| 3,747,801 | 7/1973 | Graser | 206/614 |
| 4,029,207 | 6/1977 | Gordon | 229/40 |
| 4,295,598 | 10/1981 | Calvert | 229/52 AL |
| 4,378,878 | 4/1983 | Graser | 229/52 BC |
| 4,394,903 | 7/1983 | Bakx | 206/427 |
| 4,440,340 | 4/1984 | Bakx | 229/40 |
| 4,482,090 | 11/1984 | Milliens | 229/40 |
| 4,566,593 | 1/1986 | Muller | 229/40 |

FOREIGN PATENT DOCUMENTS

| | | | |
|---|---|---|---|
| 716427 | 8/1965 | Canada | 206/161 |
| 2433711 | 1/1975 | Fed. Rep. of Germany | 229/40 |
| 1405394 | 5/1965 | France | 229/40 |
| 736218 | 9/1955 | United Kingdom | 206/427 |
| 2093434 | 9/1982 | United Kingdom | 206/145 |
| 2171672 | 9/1986 | United Kingdom | 206/612 |

*Primary Examiner*—Stephen Marcus
*Assistant Examiner*—Gary E. Elkins
*Attorney, Agent, or Firm*—John D. Lister

[57] ABSTRACT

A wrap-around beverage container carrier having end panels connected to side panel reinforcement flaps by tuck flaps. The side panel reinforcement flaps are integral with top panel reinforcement flaps, all of which are folded under to strengthen the edges of the carrier to permit it to be carried by the underside of the end portions of the top panel. The end panel height is the same dimension as the width of the reinforcement flaps, thus limiting the amount of paperboard in the blank. Neck retainer openings are provided in the top panel reinforcement flaps and are aligned with neck retainer openings in the top panel.

4 Claims, 4 Drawing Sheets

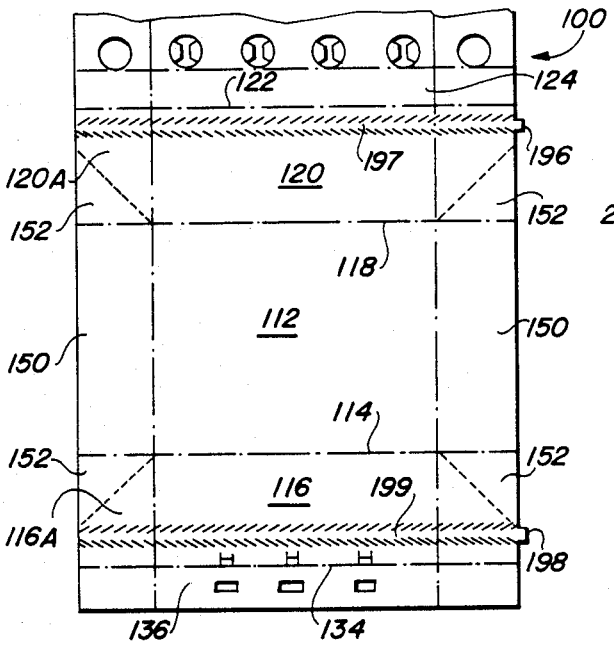
FIG. 9
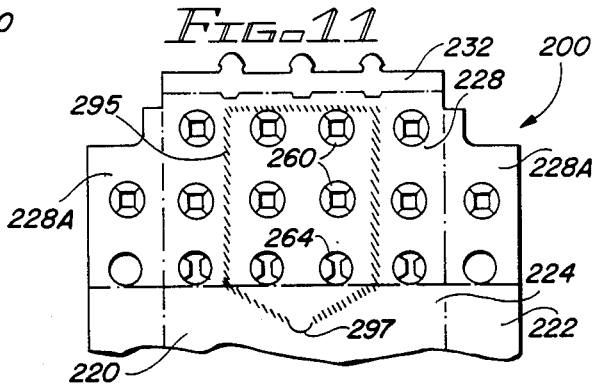
FIG. 11
FIG. 10
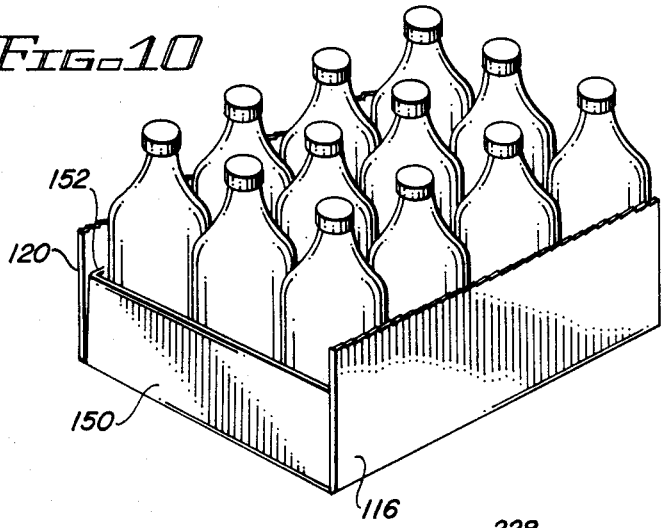
FIG. 12
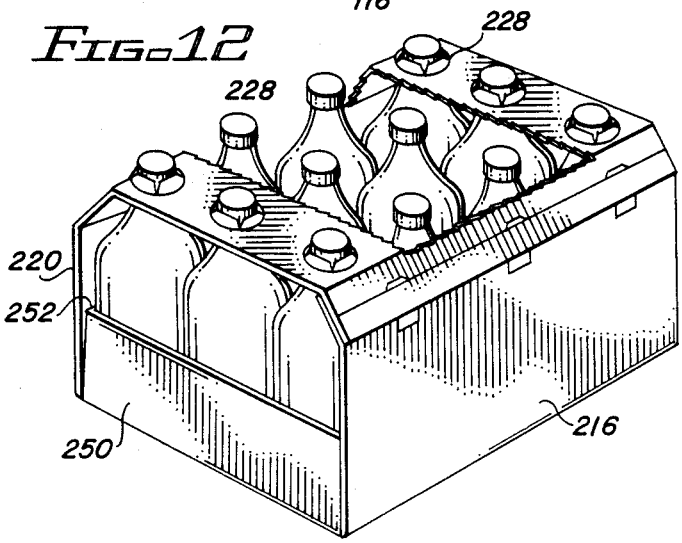
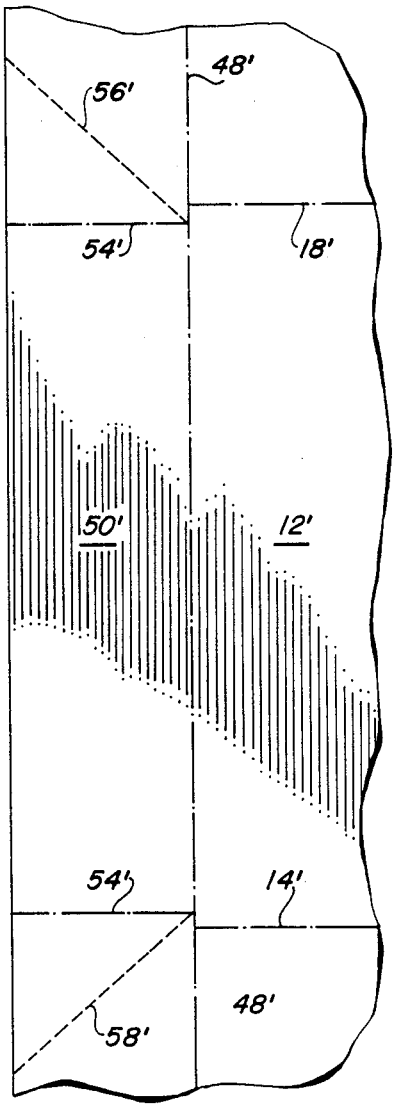
FIG. 8

WRAP-AROUND CARRIER

FIELD OF THE INVENTION

This invention relates to wrap-around article carriers. More particularly, it relates to a wrap-around article carrier having handle portions capable of lifting and carrying heavy loads.

BACKGROUND OF THE INVENTION

Wrap-around carriers are commonly utilized in the beverage industry to package containers of beer and soft drinks. Typically, carton blanks are supplied to a packaging machine which receives bottles moving at high speeds. The blanks are positioned on the moving bottles so that neck holes in the blanks fit over the necks of the upright bottles, after which the blanks are folded into place around the moving bottles. The ends of the blanks are usually fastened to each other at the bottom of the carrier by locking tabs and apertures, and a handle arrangement, such as finger openings or an integrally formed strap, is located on the top panel of the carrier to enable a user to lift and carry the package with one hand.

This type of carrier is best adapted for packages containing relatively few bottles, such as six or eight. The total weight of such a package is light enough to be lifted with one hand and can be supported by a carrier fabricated from relatively thin paperboard. Heavier packages tend to be awkward to lift with one hand and require the use of thicker more expensive paperboard in order to withstand the greater stresses of heavier loads and to prevent failure of the bottom locking tabs. Packages containing a number of large size bottles, such as, for example, twelve 16-ounce bottles, would not be well suited to the conventional design of a wrap-around carrier.

Heavy loads of bottles are more commonly packaged in an open case formed of heavier paperboard. Although such cases are better suited than conventional wrap-around carriers to support the weight of the bottles, they have certain drawbacks of their own. Since only the bottoms of the bottles are supported in the case, the bottles are more likely to fall out of the case than if the top of the case were closed. Because the sides are low, resulting in only a small amount of exposed paperboard, company logos or other advertising messages cannot readily be seen. Further, packages having closed tops carry a greater connotation of quality than do open-top cases, and for that reason alone are desired.

It would therefore be desirable to be able to use a wrap-around carrier which not only can support heavy loads, but can readily be lifted and carried. It would also be desirable for such a wrap-around carrier to be economical to produce.

BRIEF SUMMARY OF THE INVENTION

This invention comprises a carrier having side panels and end panels foldably connected to a bottom panel, and a top panel connecting the side panels. Reinforcement flaps are foldably connected to the end portions of the top panel and are folded under to form areas of double thickness. This strengthens the carrier to such an extent that a user can lift the carrier from the underside of the end portions of the top panel.

In addition, reinforcement flaps foldably connected to the side panels may be integrally formed with the top panel reinforcement flaps to strengthen the end portions of the side panels as well. The side panel reinforcement flaps are connected to the end panels by tuck flaps which allow the formation of upstanding end panels and folded-under side panel reinforcement flaps. When packaging bottles, the top panel reinforcement flaps may contain at least one bottle neck retainer opening aligned with a bottle neck retainer opening in the top panel. Further, the neck retainer openings adjacent the foldable connection between the top panel and the side panel are larger than normal to permit the top panel to be pivoted downwardly over the tops of the bottle when forming the package. Preferably, the height of the end panels is equal to the width of the reinforcement flaps and can be spaced a substantial distance from the top panel, thereby minimizing the width of the blank from which a carrier is formed.

Other features and aspects of the invention, as well as its various benefits, will become more clear in the detailed description of the preferred embodiment which follows.

BRIEF DESCRIPTION OF THE DRAWINGS

FIG. 8 is an enlarged partial plan view of a portion of a modified blank, showing the intersection of the bottom and end panel score lines;

FIG. 9 is a partial plan view of another modified production blank;

FIG. 10 is a pictorial view of a carrier formed from the blank of FIG. 9, showing the carrier after the tear strips of FIG. 9 have been removed;

FIG. 11 is a partial plan view of still another modified production blank; and FIG. 12 is a pictorial view of a carrier formed from the blank of FIG. 11, showing the carrier after the tear strip of FIG. 11 has been removed.

DESCRIPTION OF THE INVENTION

Figure 1:
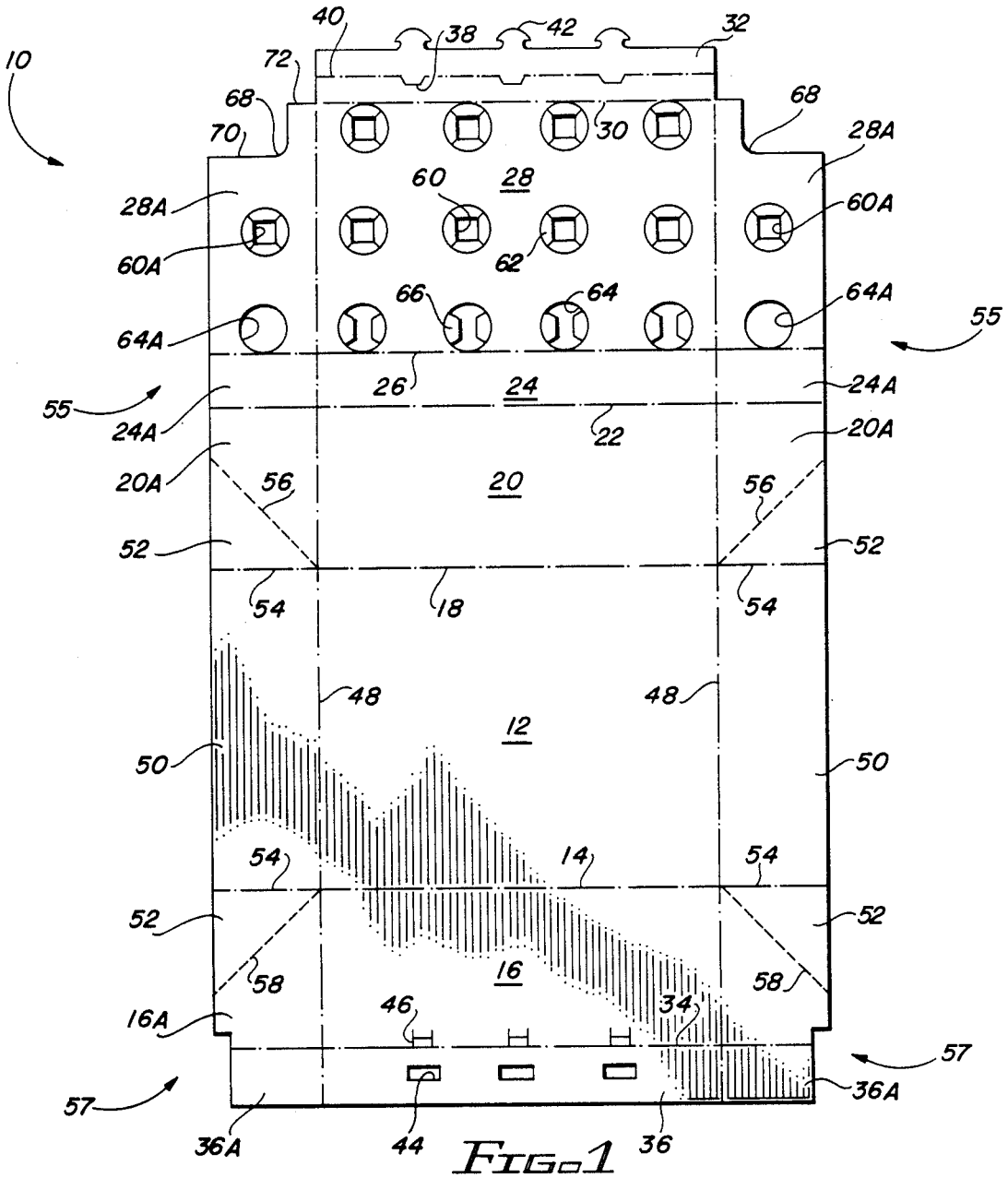
FIG. 1 is a plan view of a blank from which the carrier of the present invention is fabricated.

Referring to FIG. 1, a production blank 10 is comprised of a bottom section 12 connected by score line 14 to a first side panel section 16 and by score line 18 to a second side panel section 20. The side panel section 20 is connected by a score line 22 to angled side panel section 24, which is connected by score line 26 to top panel section 28. The top panel section 28 is connected by a score line 30 to top fastening strip 32, and the side panel section 16 is connected by a score line 34 to a side fastening strip 36. The top fastening strip 32 contains primary male locking tabs 38 the bases of which are generally aligned with score line 40, and secondary male locking tabs 52 which are aligned with the primary locking tabs 38. In like manner the fastening strip 36 contains primary female locking apertures 44 aligned with the locking tabs 38, and the side panel section 16 contains secondary female locking apertures 46 extending from the score line 34. The secondary locking apertures 46 are aligned with the secondary locking tabs 42.

Connected to the bottom section 12 along score lines 48 are end panel sections 50, which are connected to tuck flaps 52 by score lines 54. The score lines 54 in this arrangement are extensions of the score lines 14 and 18. The score lines 48 extend beyond the bottom panel section 12 to the ends of the blank, forming reinforcement flaps 55 and 57. The reinforcement flaps 55 are comprised of reinforcement flaps sections 28A, 24A and 20A, which are connected by the score lines 48 to the top panel section 28, the angled panel section 24 and the side panel section 20, respectively. The reinforcement flaps 57 are comprised of reinforcement flap sections 16A and 36A, which are connected by score lines 48 to side panel section 16 and side fastening strip 36, respectively. Two of the tuck flaps 52 are connected to reinforcement flaps 20A by fold lines 56, while the other tuck flaps 52 are connected to the reinforcement flaps 16A by fold lines 58. The score lines 48 are generally perpendicular to the score lines 14, 18, 22, 26, 30 and 34 so as to result in a carrier having panels that extend generally at right angles to each other. In the arrangement shown, the fold lines 56 and 58 form an angle of 45° with the score lines 48 and 54.

Still referring to FIG. 1, the top panel section 28 contains twelve neck retainer openings arranged in three rows of four openings each. The openings 60 in the outer two rows include four tabs 62 foldably connected to the top panel section which enables the necks of bottles contained in the carrier to protrude through the openings and yet be engaged substantially entirely around the periphery of the neck to hold the neck in place. This type of neck retainer structure is conventional in the art. The openings 64 in the innermost row of openings are larger in a transverse direction than the openings 60, and are provided with only two tabs 66 which, like the tabs 62, are foldably connected to the top panel section. The reason for the different neck retainer structures will be explained hereinafter. In addition, each of the reinforcement flaps 28A contains a neck retainer opening 60A and a neck retainer opening 64A. As illustrated, the openings 60A preferably are identical to the openings 60, while the openings 64A preferably are identical in shape and size to the openings 64 but are not provided with neck retaining tabs. The reinforcement flaps 28A are further provided with cutout portions 68 which take up the space in which neck retainer openings similar to openings 60A could have been located, and reinforcement flaps 36A and 16A are provided with cutout portions adjacent their outer edges, for reasons which will be explained hereinafter.

Figure 2:
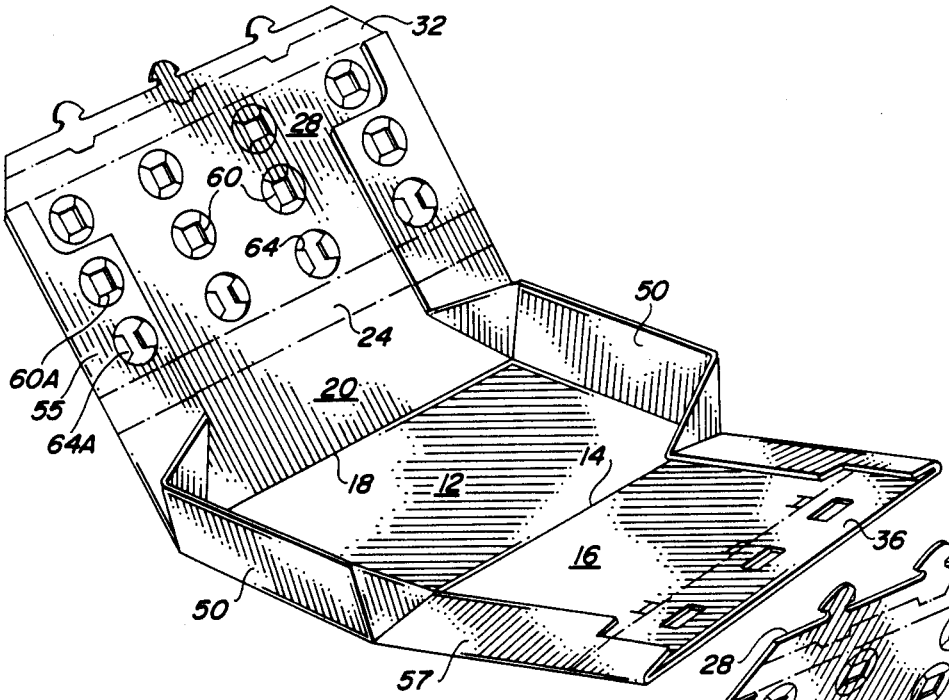
FIG. 2 is a pictorial view of the blank of FIG. 1 in a partially folded state, the bottles about which the blank is folded being omitted for purpose of clarity.

Referring to FIGS. 1 and 2, and assuming that the surface of the blank facing the viewer in FIG. 1 is the inside surface of the blank, the first step in folding the blank 10 to form a carrier is to push the tuck flaps 52 upward and toward the score lines 54. This causes the paperboard to fold along the fold lines 56 and 58, moving the fold lines up out of the plane of the blank and raising the end panel sections 50 and the reinforcement flaps 55 and 57. It also causes the side panel section 16 and the fastening strip section 36 to be hinged up as a unit about score line 14, and the side panel section 20, the angled section 24, the top panel section 28 and the fastening strip 32 to be hinged up as a unit about the score line 18. The reinforcement flaps 55 and 57 are continued to be folded about score lines 58 until they overlie the adjacent panel sections as shown in FIG. 2. Note that the neck retainer openings 60A and 64A are aligned with and overlie the end openings 60 and 64 in the adjacent rows of openings to allow the necks of the bottles to protrude through both openings. It should be understood that although bottles are not shown in FIG. 2 so as not to interfere with the illustration of the carrier components, in actual practice the bottles to be packaged would first be positioned on the bottom section of the blank, after which the folding would proceed as outlined above.

Figure 3:
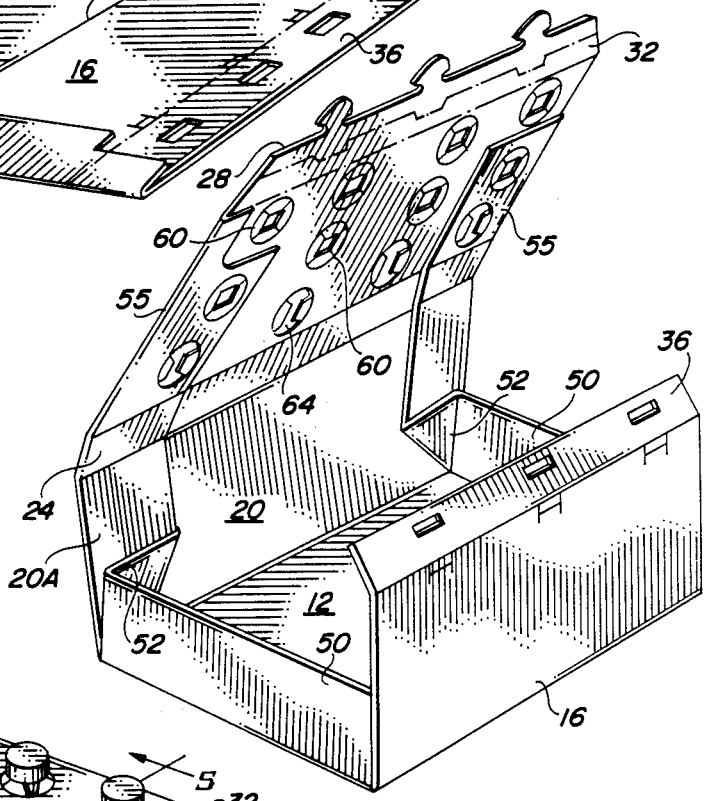
FIG. 3 is a pictorial view similar to that of FIG. 2, but showing the blank in a latter stage of fabrication.

The blank, still in the intermediate form of FIG. 2, is continued to be folded along score lines 14 and 18 to bring the side panel sections 16 and 20 up to vertical, and is also folded about score lines 22 and 26 to form the intermediate configuration shown in FIG. 3. The tuck flaps 52 at this point are face to face with the adjacent portions of the reinforcement flaps 16A and 20A and the top panel section 28 is in the process of being folded down over the bottles which would be sitting on the bottom section. At this point it can be seen that if the top panel of the carrier were connected directly to the side panel without being separated by the angle section 24, there would be no room for the top panel section to be pivoted down over the top of the adjacent row of bottles. Similarly, if the neck retainer openings 64 were the same size as the other close-fitting openings 60, the arc through which the openings 64 move as the top panel section is pivoted downwardly over the tops of the bottle would be too short to enable the openings 64 to be molded over the bottle necks. The angled panel section 24 and the enlarged neck openings 64 are thus provided to enable the top panel section 28, and all the neck retainer openings therein, to be properly aligned with the bottles as the top panel section is folded down over the bottles. Because neck retainer flaps at the short ends of the neck retainer openings 64 could tend to interfere with the movement of the top panel down over the row of openings 64, they preferably are omitted as shown. In order to be certain that the neck retainer openings 64A in the reinforcement flap 28A do not interfere with the movement of the top panel during this folding operation, all neck retainer flaps on these openings preferably are omitted as shown.

Figure 4:
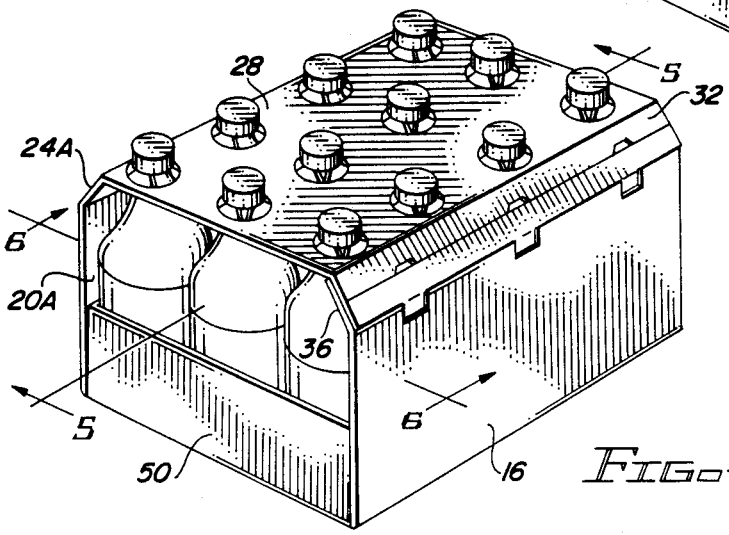
FIG. 4 is a pictorial view of a completely fabricated carrier of the present invention.

Further downward facing of the top panel section is continued until the fastening strip 32 overlies the fastening strip 36 and then is connected thereto. The finished carrier, with bottles in place, is shown in FIG. 4, wherein the necks of all twelve bottles extend upwardly through the associated neck retainer openings in the top panel 28. The angled panel 24 and the combined fastening strips 32 and 36 form the same angle with the side panels so that the carrier is symmetrically arranged. The end panels 50 are held in erect vertical position by the folded tuck flaps. The bottles in the carrier, which are tightly packed and abut the side panels 16 and 20, also abut the tuck flaps, pushing against them and pinning them against the adjacent folded-over reinforcement flaps 20A and 16A. Thus the bottles in the package assist in holding the tuck flaps in position.

Figure 5:
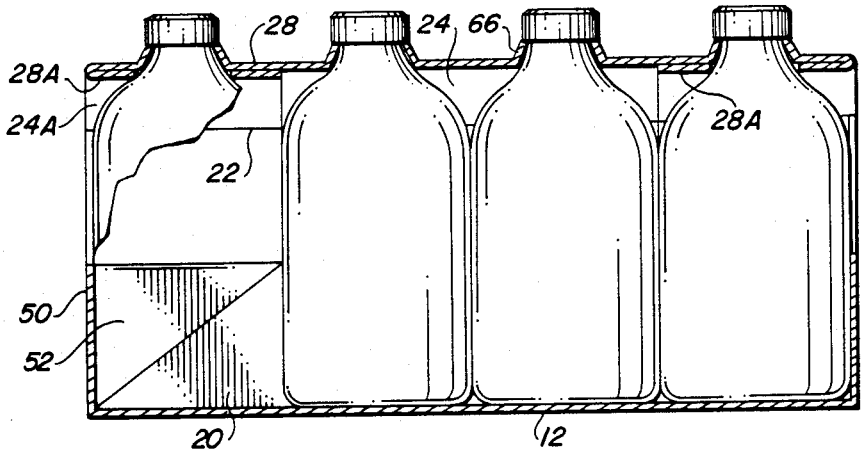
FIG. 5 is a sectional view taken on line 5—5 of FIG. 4.

The individual folded-over reinforcement flaps which make up the reinforcement flaps 55 and 57 provide a double thickness of paperboard along the edges of the top panel of the carrier, thereby strengthening the top panel to such an extent that a user can grasp the underside of the top panel adjacent its edges and easily lift the carrier. The reinforced edge portions thus serve as handle portions. This is more clearly brought out in FIGS. 5 and 6, which show sectional views of the package taken on the planes indicated in FIG. 4. As shown in FIG. 5, reinforcement flap 28A extends beyond the first neck retainer opening 64 approximately to the far side of the first bottle in the row. This provides ample room for the fingers of a user so that substantially all the lifting stresses occur in the area of double thickness. The end panels 50, which are shown immediately adjacent the end bottles, assist in holding the bottles in place and function with the side panels in completely enclosing the bottles in the package.

Figure 6:
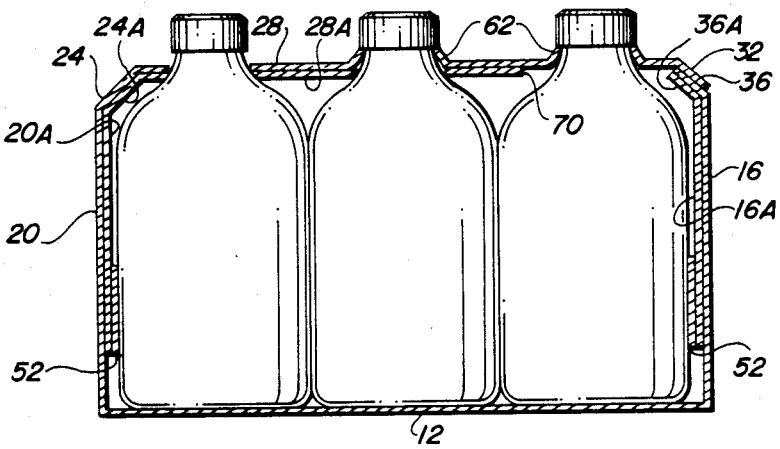
FIG. 6 is a sectional view taken on line 6—6 of FIG. 4.

As shown in FIG. 6, the reinforcement flaps provide a double thickness of paperboard at the edge portions of the side panels of the package as well as along the edge portions of the top panel. The tuck flaps 52 add an additional thickness to make a triple thickness at the critical locations where the end bottles in the outer rows abut the side panels. There is also a triple thick area where the fastening strips 32 and 36 meet. The end edge of the reinforcement flap 28A is indicated at 70, which corresponds to the cutout 68 shown in FIG. 1. This shortened portion of the reinforcement flap 28A takes away the possibility of a wide unattached edge of the flap 28A binding with other flaps in the congested region where the fastening strips come together, and it also eliminates a neck retainer opening corresponding to opening 60A, thereby obviating possible interference in this area with bottle alignment. The short end 72 of flap 28A provides continuous double thickness throughout the width of the top panel of the package without causing any of the possible interference problems just mentioned.

Figure 7A:
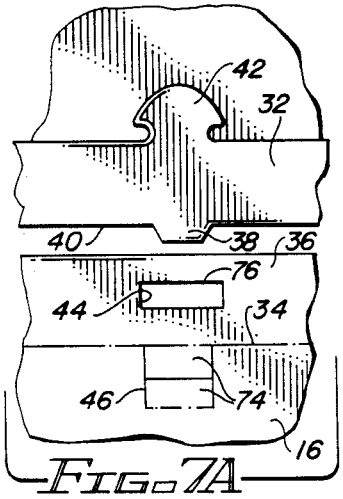
FIGS. 7A, 7B and 7C are enlarged partial side views of the locking means for securing the fastening strips of the carrier in place, sequentially showing the main steps in the locking process.
Figure 7B:
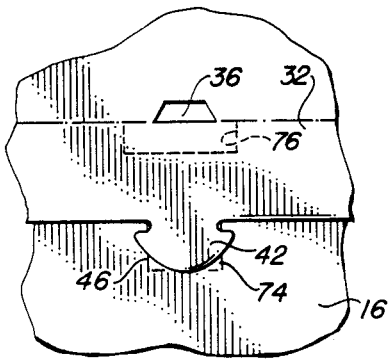
Figure 7C:
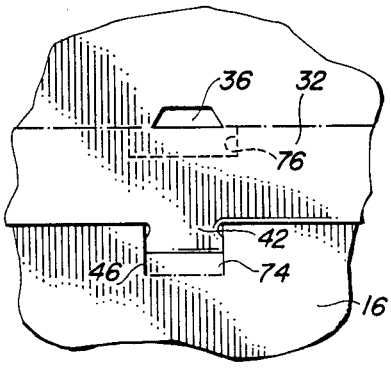
Figure 7D:
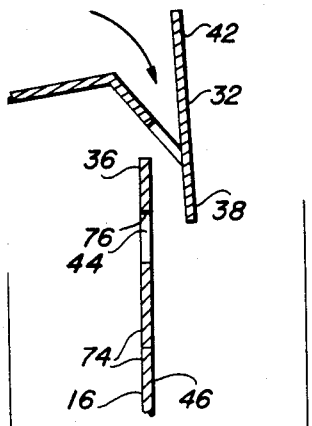
FIGS. 7D, 7E and 7F are enlarged partial sectional views taken through the center of the locking tabs shown in FIGS. 7A, 7B and 7C, respectively, and corresponding to the locking stages illustrated therein.
Figure 7E:
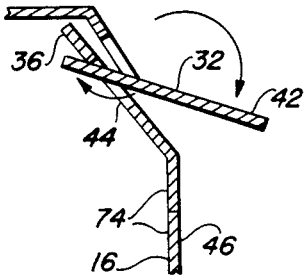

Referring now to FIGS. 7A and 7D, the fastening strips 32 is shown as it is ready to engage the fastening strip 36. The strip 32 has been folded back along the score line 40 so that the underside of the strip 32 is exposed while the outer side of the fastening strip 36 is seen. This separates the primary locking tabs 38 from the strip 32. The primary locking tab 38 is aligned with the primary locking aperture 44, and the secondary locking tab 52 is aligned with the secondary locking aperture 46. The locking aperture 46 is preferably covered by tabs 74 foldably connected to the side panel 16 and the score line 34. To complete the primary lock, the locking tab 38 is inserted into the aperture 44 and the strip 32 is folded back down along the score line 40, as best illustrated in FIG. 7E. This causes the tab 38 to pivot about the edge 76 of the aperture 44 and to come to rest face to face with the inside surface of the strip 36. The secondary or punch tab 42 at this point is aligned with the secondary aperture 46. This arrangement is illustrated in FIG. 7B.

Figure 7F:
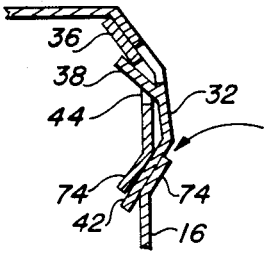

The next step in locking the locking strips together is to insert the punch tab 52 into the aperture 46, forcing the tab through the slightly narrower opening between the foldable tabs 74. This step completes the locking operation so that the strips are connected as shown in FIGS. 7C and 7F, by both the primary and secondary locks. It should be understood that while this is the preferred locking arrangement because of its holding power under heavy loads, other mechanical locking designs could be used instead, so long as they are capable of securely holding the locking strips together. If preferred, however, the strips could be glued together instead of being mechanically interlocked. If even more locking integrity is required, both a mechanical lock and glue could be employed in the same package.

In the description of the tuck flaps in connection with the blank of FIG. 1, the fold lines 56 and 58 which form the tuck flaps 52 were stated to form an angle of 45° with the score lines 48 and 54. This is the normal arrangement of tuck flaps, and results in the end panel 50 being generally vertically disposed. In FIG. 8 a modified arrangement is shown wherein the score lines 54' are offset from the score lines 18' and 14' so that the distance between the score lines 18' and 14' is greater than the distance between the score lines 54'. In addition, instead of the fold lines 56' and 58' making 45° angles with the score lines 48' and 54', the fold lines 56' and 58' form an angle less than 45° with the score lines 54' and an angle greater than 45° with the score lines 48'. With this arrangement the end panel 50' tends to bow slightly inwardly toward the contents of the carrier after the package has been fabricated. This guards against slack end panels and the consequent problem of the end bottles sliding within the package and bumping adjacent bottles. The specific angles and offsets that may be used will vary with the size of the package and the amount of inward bias desired, with greater offsets being required with greater angular departures from 45°. It should be understood, however, that the rectilinear arrangement of the panels does not permit large variations from the FIG. 1 embodiment. A preferred design, for example, combines a 3/32 inch offset with a 43° acute angle formed by score lines 54' with fold lines 56' and 58'. In such an arrangement the obtuse angle formed by score line 48' with fold lines 56' and 58' would be 47° so that the sum of the acute and obtuse angles is always substantially 90°.

Referring now to FIG. 9, a modified blank 100 comprises a bottom panel section 112, end panel sections 150, side panel sections 120 and 116, and side panel reinforcement flaps 120A and 116A, all of which correspond to their counterpart panel sections in the blank of FIG. 1. In addition, the side panel section 120 contains a tear strip 197 near the score line 122 connecting the side panel section of the angled panel section. Similarly, the side panel section 116 contains a tear strip 199 near the score line 134 connecting the side panel section to the fastening strip 136. The tear strips are parallel to the score lines 122 and 134 and preferably are provided with extensions 196 and 198 to enable a user to grasp the tear strips.

In practice, a user will carry the filled carrier in the manner described earlier, with the folded-under reinforcement flaps enabling the carrier to support the load. To expose the contents of the carrier it is simply necessary to remove the tear strips 197 and 199, resulting in the carrier shown in FIG. 10. All the bottles are readily accessible and the base of the carton is still intact, consisting of the bottom, side and end panels. In this embodiment the tuck panels 152 would be glued to the side panel reinforcement flaps 120A and 116A since the mechanical fasteners which normally hold the top and side panels in place are no longer there. To readily remove the tear strips without interfering with the glued areas, it is preferable to locate the tear strips at a distance from the score lines 114 and 118 which is equal to or greater than the height of the side panels of the carrier. This causes the side panels remaining after the tear strips have been removed to be at least as high or higher than the end panels, as shown in FIG. 10.

A different modified blank is shown in FIG. 11, wherein blank 200 comprises a top panel section 228 connected by score lines to reinforcement flaps 228A, fastening strips 232 and angled panel section 224. The top panel section further contains spaced legs of a tear strip 295 which separate the middle two neck retainer openings 260 and 264 from the neck retainer openings located outwardly thereof. The tear strip 295 also has a leg extending along a portion of the score line connecting the fastening strip 232 to the top panel section 228. The spaced legs of the tear strip also extend into the angled panel section 224, terminating at the score line 222 in a tab 297.

In practice, the carrier is formed the same as the carrier of FIS. 1–7, the reinforcement flaps enabling heavy bottles loads to be carried without unduly stressing the paperboard. In order to expose the contents of the carrier the user simply pulls on the tab 297 and removes the tear strip 295, which as shown in FIG. 12 removes the central portion of the top panel. In a carrier designed to carry twelve bottles this exposes the middle six bottles. After the middle six bottles have been removed it is an easy matter to reach in through the space vacated by the bottles and remove the other bottles. This arrangement leaves the locking tab and aperture combinations intact, which holds the top panel securely in place after the central portion has been removed. This is especially useful when dealing with returnable bottles since the empty bottles can be placed back into the carrier and returned by the carrier to the retail outlet. Even with a portion of the top panel removed the carrier has enough structural integrity to withstand the load of the empty bottles in order to carry them back to the retail outlet.

It should now be clear that the carrier of the present invention represents a significant improvement in the field of wrap-around carriers, particularly when it is desired to package a large number of bottles to create a package too heavy or awkward to carry by the usual handle designs. The carrier is simple to fabricate, requiring no glue. The pressure exerted by the bottles in the package against the side and end panels, as well as the stabilizing effect of the neck retainers, is enough to hold the tuck flaps and reinforcement flaps in place without the need for adhesive.

It should be understood that while the preferred embodiment has been disclosed for use in connection with bottles, the idea of utilizing folded reinforcement flaps as a means for lifting the package could be utilized in connection with cans also. In such a design the angled panel connecting the top panel to the side panel need not be incorporated since there would be no need to extend the arc of the top panel in order to properly align neck retainer openings with bottle necks. The top panel could in such a case extend at right angles from the side panel. If required, portions of the top panel could be struck down against the tops of the cans to assist in holding the cans in place.

It should now be obvious that although a preferred embodiment of the invention has been described, changes to the specific details of the embodiment, in addition to or instead of the possible modifications suggested, can be made without departing from the spirit and scope of the invention as defined by the claims.

What is claimed is:

1. A wrap-around article carrier, comprising:

a bottom panel having side edges and end edges;

side panels connected to the side edges of the bottom panel by fold lines;

end panels connected to the end edges of the bottom panel by fold lines;

a top panel connecting the side panels;

end portions of the top panel being folded under to form areas of double thickness of sufficient strength to engage the carrier to be lifted by the end portions of the top panel;

tuck flaps connected to the end panels along fold lines and end portions connected to the side panels along fold lines, the side panel end portions being connected to the tuck flaps along diagonal fold lines;

the side panel end portions being folded in to form areas of double thickness, the folded-in portions of the side panels being connected to the folded-under portions of the top panel;

at least one of the side panels having an angled upper portion adjacent the top panel, the angled portions forming an obtuse angle with the associated side panel and an obtuse angle with the top panel, the angled portion being connected to the top panel;

the top panel containing a plurality of neck retainer openings for receiving the necks of bottles contained in the carrier, the neck retainer openings nearest the connection between the top panel and the angled upper portion of said one side panel being larger than the neck retainer openings more distant from said connection to enable the top panel to be closed over the tops of bottles positioned on the bottom panel during formation of the carrier; and each of the folded-under portions of the top panel containing at least one neck retainer opening, the neck retainer openings of the folded-under portions of the top panel being aligned with neck retainer openings in the top panel.

2. A blank for forming a wrap-around article carrier, comprising:

a bottom panel section;

side panel sections connected to the bottom panel section by score lines;

end panel sections connected to the bottom panel section by score lines;

a top panel section connected to at least one of the side panel sections by a score line, the top panel section having end edges;

reinforcement flaps connected to the end edges of the top panel by score lines, the reinforcement flaps being adapted to be folded about their score lines to a position facing the underside of the top panel of a carrier formed from the blank to reinforce the ends of the top panel;

tuck flaps connected to the end panel sections along score lines parallel to the score lines connecting the bottom panel section to the side panel sections;

reinforcement flaps connected to the side panel sections along score lines and to the tuck flaps along diagonal fold lines, the side panel reinforcement flaps being further connected to the top panel reinforcement flaps along score lines, the side panel reinforcement flaps being adapted to be folded about the score lines connecting the side panel reinforcement flaps to the side panel sections to a position facing the inside of the side panels of a carrier formed from the blank to reinforce the ends of the side panels;

the distance between the score lines connecting the tuck flaps to the end panel sections being less than the distance between the score lines connecting the bottom panel section to the side panel sections; and the angle formed by the diagonal fold lines with the score lines connecting the tuck flaps to the end panel sections being slightly less than 45° and the angle formed by the diagonal fold lines with the score lines connecting the end panel sections to the bottom panel section being slightly greater than 45°, the sum of said angles being substantially 90°.

3. A blank for producing a wrap-around article carrier according to claim 2, wherein the angle formed by the diagonal fold lines with the score lines connecting the tuck flaps to the end panel sections is about 43° and the angle formed by the diagonal fold lines with the score lines connecting the end panel sections to the bottom panel section is about 47°.

4. A blank for producing a wrap-around article carrier according to claim 2, wherein the width of the top panel reinforcement flaps, the width of the side panel reinforcement flaps and the width of the end panel sections are substantially the same.

* * * * *

UNITED STATES PATENT AND TRADEMARK OFFICE

CERTIFICATE OF CORRECTION

PATENT NO. : 4,836,375

DATED : June 6, 1989

INVENTOR(S) : Richard Lee Schuster, et al

It is certified that error appears in the above-identified patent and that said Letters Patent is hereby corrected as shown below:

Col. 8, claim 1, line 11, delete "engage" and insert therefore --enable--

Signed and Sealed this

Nineteenth Day of January, 1993

*Attest:*

DOUGLAS B. COMER

*Attesting Officer*

*Acting Commissioner of Patents and Trademarks*